US010798497B2

(12) United States Patent
Chang

(10) Patent No.: US 10,798,497 B2
(45) Date of Patent: Oct. 6, 2020

(54) HEARING AID DEVICE AND A SYSTEM FOR CONTROLLING A HEARING AID DEVICE

(71) Applicant: Tom Yu-Chi Chang, Bellevue, WA (US)

(72) Inventor: Tom Yu-Chi Chang, Bellevue, WA (US)

( * ) Notice: Subject to any disclaimer, the term of this patent is extended or adjusted under 35 U.S.C. 154(b) by 30 days.

(21) Appl. No.: 16/026,090

(22) Filed: Jul. 3, 2018

(65) Prior Publication Data

US 2020/0015022 A1 Jan. 9, 2020

(51) Int. Cl.
*H04R 25/00* (2006.01)
*H04R 25/02* (2006.01)

(52) U.S. Cl.
CPC ..... *H04R 25/554* (2013.01); *H04R 25/60* (2013.01); *H04R 25/02* (2013.01); *H04R 25/40* (2013.01); *H04R 2225/31* (2013.01); *H04R 2225/51* (2013.01)

(58) Field of Classification Search
CPC ..... H04R 25/554; H04R 25/60; H04R 25/02; H04R 25/40; H04R 2225/31; H04R 2225/51
USPC ..... 381/314
See application file for complete search history.

(56) References Cited

U.S. PATENT DOCUMENTS 4,638,125 A * 1/1987 Buettner ..... H04R 25/65 381/324
5,784,470 A * 7/1998 Fackler ..... H04R 25/602 381/328
5,802,183 A * 9/1998 Scheller ..... H04R 25/554 381/322
5,916,698 A * 6/1999 Diederiks ..... H01M 2/1038 327/581
6,985,598 B1 * 1/2006 Joschika ..... H04R 25/556 381/312
8,213,655 B2 * 7/2012 Kral ..... H04R 25/65 361/816
2005/0008178 A1 * 1/2005 Joergensen ..... H01H 13/84 381/322
2009/0262964 A1 * 10/2009 Havenith ..... H04R 25/505 381/314
2013/0343585 A1 * 12/2013 Bennett ..... H04R 25/554 381/315
2014/0294214 A1 * 10/2014 Zhao ..... H04R 25/656 381/330

* cited by examiner

*Primary Examiner* — Phylesha Dabney
(74) *Attorney, Agent, or Firm* — Bacon & Thomas, PLLC

(57) ABSTRACT

A hearing aid device comprising: a body, accommodating a circuit unit; a ear mold, capable of being accommodated in ear canal to convey sound; a connecting portion, capable of connecting the body with the ear mold; a wireless transmission unit, electrically coupled with the circuit unit, capable of communicating with at least one wireless device; and a rechargeable battery unit, coupled with the body and provided with a convex structure on a side facing the body.

14 Claims, 20 Drawing Sheets

HEARING AID DEVICE AND A SYSTEM FOR CONTROLLING A HEARING AID DEVICE

FIELD

The present invention relates to a hearing aid device, particularly relates to a waterproof hearing aid device.

BACKGROUND OF THE DESCRIPTION

An open-type battery, such as a button-type mercury battery, is usually used as a power source in existing hearing aid device, which is easy to be installed but its compartment has poor water resistance. The mercury battery is a disposable battery, thus we often throw out the used battery and install a new mercury battery, when power of the mercury battery is exhausted, which cause serious environmental pollution.

Secondly, in conventional hearing aid device, gaps are generated by physical buttons, and a aperture is required by microphone to receive sound, thus the conventional hearing aid device is poor waterproof, for example, at high humidity, sweat is generated during exercise, even in the water activities, etc., the gaps or openings on the device causing water or humid air enters into the device, resulting in damage or abnormality of the device.

In addition, the conventional hearing aid device only collects the sound in the environment and outputs the amplified sound signal to the user, but does not consider the situation when the user uses a wireless device (for example, a Bluetooth device), that is, the user does not only need the hearing aid device in daily life, when the user uses the electronic device, the user also needs another device with hearing aid function to listen to the sounds from the electronic device clearly.

In addition, conventional hearing aids typically require calibration by audiologist or technicians in order to be programmed for the user's individual impairment needs. The user is unable to do this calibration on his own. Furthermore, once programmed, the user cannot make adjustments to either increase or reduce amplification at specific sound frequencies; which may be desirable based on the environment the user is in. This limits the flexibility and adaptability of conventional hearing aids.

SUMMARY OF THE INVENTION

In view of the purpose of the present invention, the present invention provides a hearing aid device comprising: a body, accommodating a circuit unit; a ear mold, capable of being accommodated in ear canal to convey sound; a connecting portion, capable of connecting the body with the ear mold; a wireless transmission unit, electrically coupled with the circuit unit, capable of communicating with at least one wireless device; and a rechargeable battery unit, coupled with the body and provided with a convex structure on a side facing the body, so that after assembling the body and the rechargeable battery unit together, the hearing aid device can be sealed to achieve better waterproof.

In view of the purpose of the present invention, the present invention provides a system for controlling the hearing aid device according to one embodiment, wherein the system comprising a user interface comprising: a sound source selection unit for the user to select at least one sound source input to the hearing aid device; and a mixing unit, for the user determining input ratio of the different sound sources when the user selects more than one sound source. In different situations, different sound output ratio of sound sources are determined by the user. In one embodiment, the user can also listen to the ambient sound while using the Bluetooth device to listen music such that the user can notice the car passing by and it can reduce the possibility of accidents.

In view of the object of the present invention, the present invention provides a system for controlling the hearing aid device according to claim 1, wherein the hearing aid device comprising a left and a right hearing aid device, to respectively output sound to the user's left ear and right ear.

BRIEF DESCRIPTION OF DRAWINGS

The embodiments of the present application are shown by way of example and not limitation in the accompanying drawings, like numerals being used for like elements.

FIG. 4 A illustrates a side view of the battery unit of the invention.

FIG. 4A-1 illustrates a side view of the battery unit according to another embodiment of the present invention.

FIG. 4B-1 illustrate a side view of different direction of the battery unit according to another embodiment of the present invention.

FIG. 4C-1 illustrates a top view of the battery unit according to another embodiment of the present invention.

DETAILED DESCRIPTION

The principles of the present invention will be described below with reference to a number of illustrative embodiments shown in the accompanying drawings. It should be understood that these embodiments are described merely to enable those persons skilled in the art to better understand the present invention, and are not intended to limit the scope of the present invention in any way.

Figure 1:
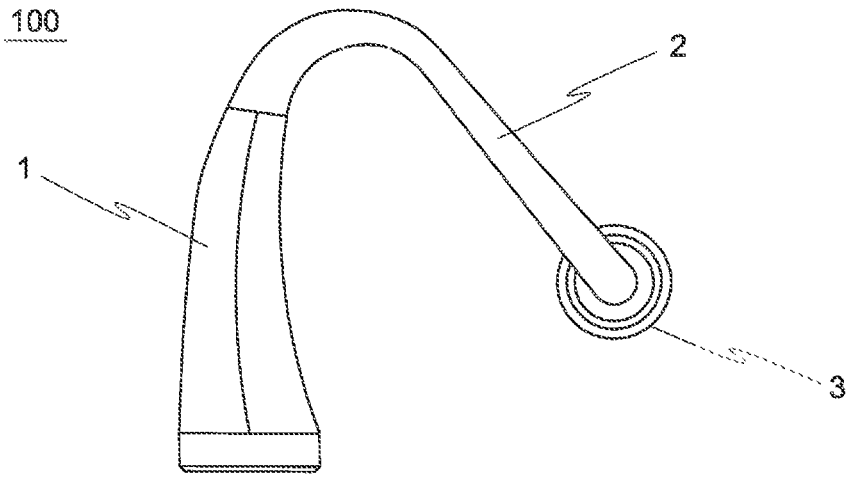
FIG. 1 illustrates a schematic diagram of a hearing aid device according to an embodiment of the present invention.

FIG. 1 illustrates a schematic diagram of a hearing aid device according to an embodiment of the present invention. The user may use a hearing aid device, and may use more than one device according use's requirement. The hearing aid device 100 comprising a body 1, a connecting portion 2, and an ear mold 3. The body 1 may be a case, and a circuit unit (not shown) for realizing functions of the hearing aid device 100 may be accommodated inside the body 1. Ear mold 3 may be a speaker matching shape and size of the ear canal, capable of being accommodated in ear canal, and sound is transmitted to the user's ear through the ear mold 3. The connecting portion 2 is configured to connect the body 1 with the ear mold 3, are comply with the size of the user's ear, in one embodiment, length of outer circumference of the connecting portion 2 is smaller than length of inner circumference of the ear canal of the user, and gradually decreases from the body 1 to ear mold 3. However, the connecting portion 2 is not limited to this, and may be formed in an irregular manner and matched with the shape of the ear canal of the user.

Figure 2:
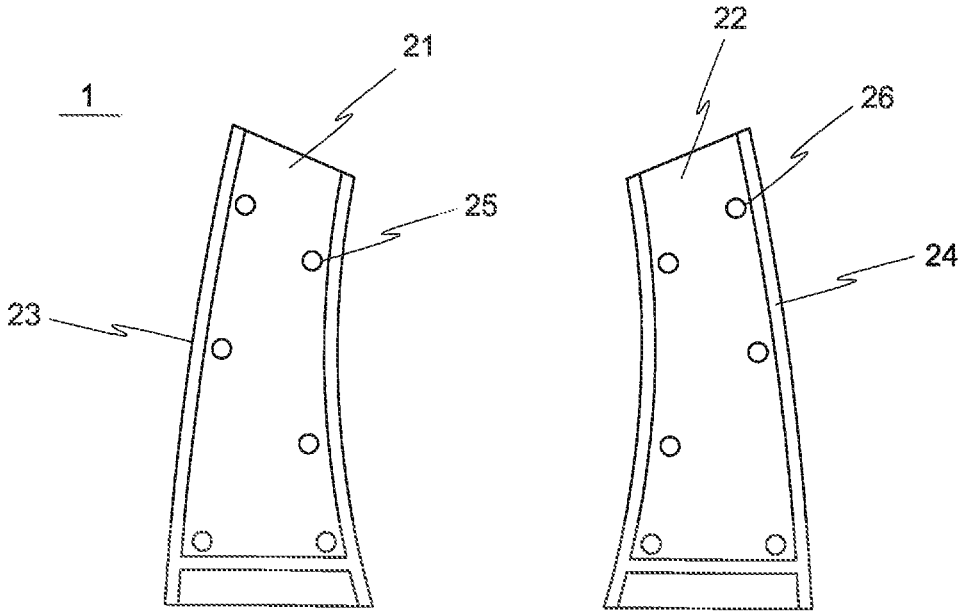
FIG. 2 illustrates an exploded view of the body according to an embodiment of the present invention.

FIG. 2 illustrates an exploded view of the body according to an embodiment of the present invention. In an embodiment, the body 1 comprises an upper case 21 and a lower case 22, and the upper case 21 and the lower case 22 have a sealing structures 23-24 around the upper case 21 and a lower case 22. The sealing structures 23-24 are positioned between the upper case 21 and the lower case 22 when the upper case 21 is assembled with the lower case 22. In one embodiment, the sealing structure is a waterproof rubber. The material of the sealing structure is not limited, as long as the upper case 21 and the lower case 22 are coupled with each other closely so that a waterproof effect can be achieved when the upper case 21 is assembled with the lower case 22. The body 1 may be composed of at least two cases, or may be integrally formed in one piece, or may be integrally formed with the connecting portion 2 and the ear mold 3. The upper case 21 and the lower case 22 further have at least one mounting structure 25 and 26. In an embodiment, the mounting structures 25, 26 of the upper case 21 and the lower case 22 are matched with each other. When the upper case 21 and the lower case 22 are coupled with each other via the mounting structure 25 and 26, the stability of the assembling the upper case 21 and the lower case 22 are improved, the hearing aid device will not be easily broken up even if the hearing aid device collides or falls on the ground. In an embodiment, the mounting structures 25 are convex structures, and the mounting structures 26 are corresponding concave structures.

Figure 3:
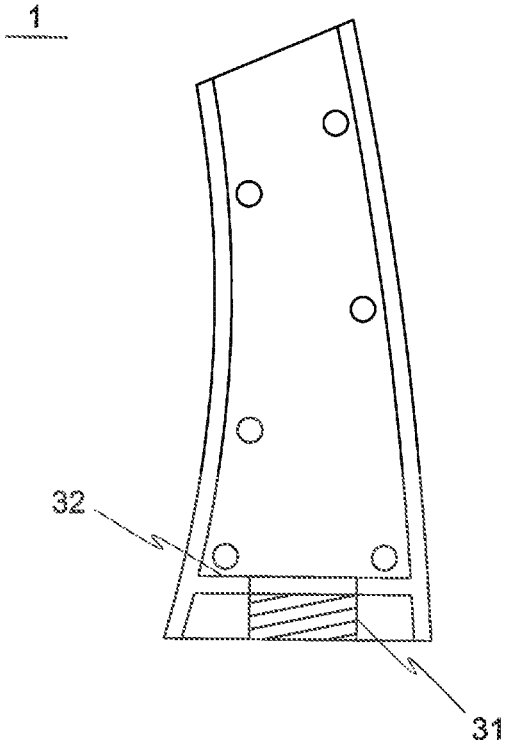
FIG. 3 illustrates a sectional view of a body according to another embodiment of the present invention.
Figure 3A:
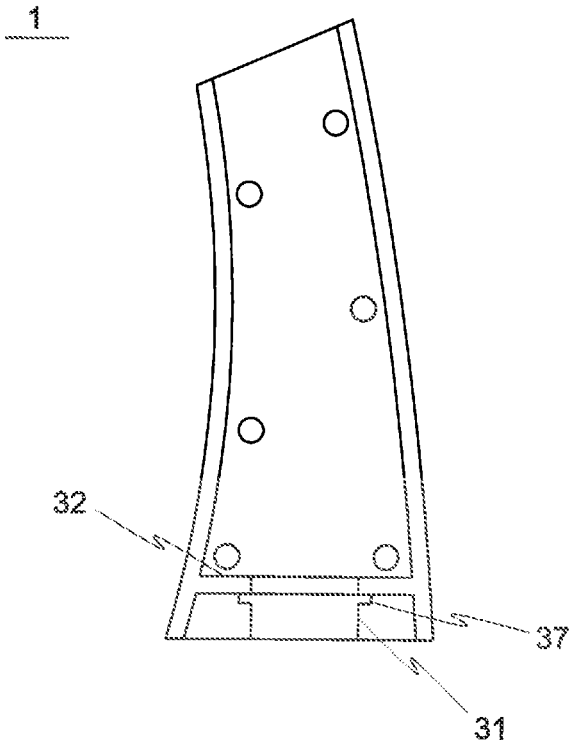
FIG. 3A illustrates a sectional view of a body according to another embodiment of the present invention.
Figure 4A:
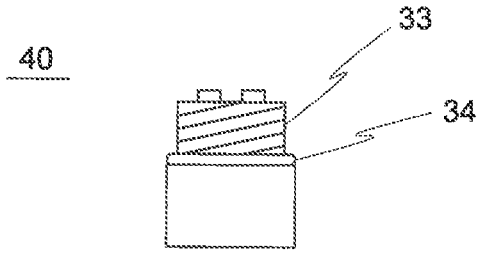
Figure 4B:
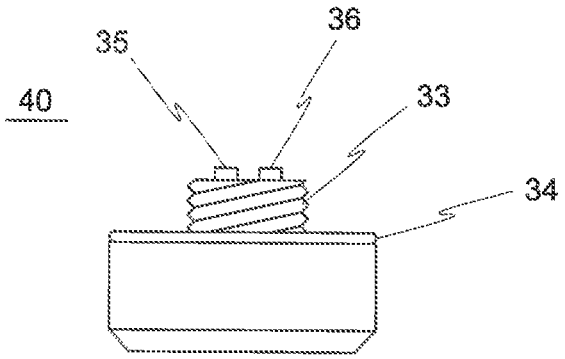
FIG. 4B illustrate a side view of different direction of the battery unit of the invention.
Figure 4C:
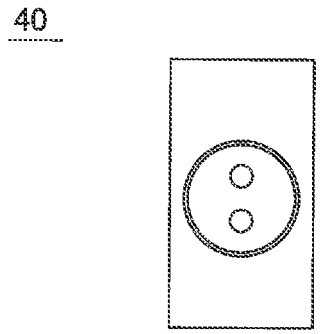
FIG. 4C illustrates a top view of the battery unit of the invention.
Figures 1, 4A:
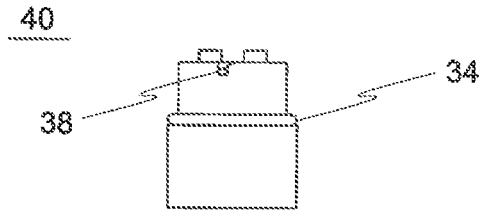
Figures 1, 4B:
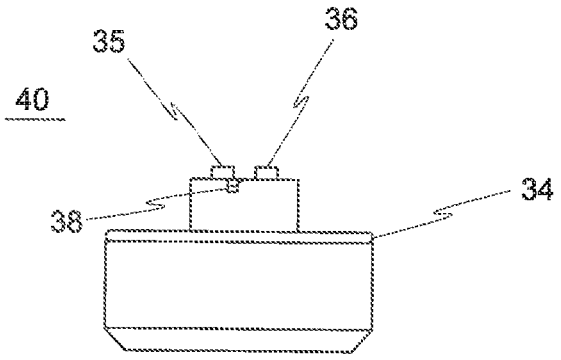
Figures 1, 4C:
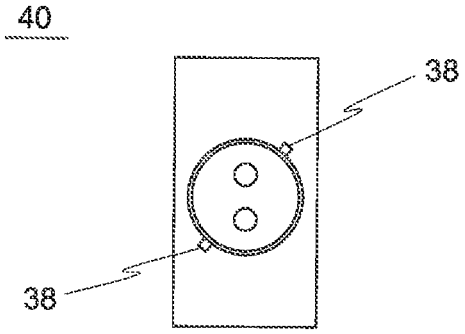

Next, please refer to FIG. 3 and FIGS. 4A-4C. FIG. 3 illustrates a sectional view of a body according to another embodiment of the present invention. FIG. 4 A illustrates a side view of the battery unit of the invention; FIG. 4B illustrates a side view of different direction of the battery unit of the invention; FIG. 4C illustrates a top view of the battery unit of the invention. In an embodiment, the body 1 comprises a threaded end portion 31 and a mounting surface 32, wherein the thread of the end portion 31 and the thread 33 of the battery unit 40 match each other. For example, the end portion 31 has a male thread and the battery unit 40 has a corresponding female thread 33. However, the battery unit 40 and the end portion 31 does not necessarily have thread matched with each other, but may also have a corresponding snap structure to be coupled with each other (for example shown as FIGS. 3A, 4A-1, 4B-1 and 4C-1, the snap structure comprising a portion 38 on the the battery unit 40 and a corresponding portion 37 on the end portion 31), or may be any other structure configured to couple the battery unit 40 with the end portion 31. The vertices of the battery unit 40 are positive and negative electrodes 35, 36, respectively. When the body 1 and the battery unit 40 are completely mounted, the electrodes 35-36 of the battery cell 40 and the electrodes of the body 1 are electrically coupled on the mounting surface 32. In one embodiment, the battery unit 40 further has a convex structure 34 on the outside of the thread or on a side facing the body 1. In one embodiment, the convex structure 34 is a washer, but may also be a waterproof rubber, such that when the body 1 and the battery unit 40 are coupled with each other, the whole structure is sealed and waterproof is achieved. Wherein, the convex structure may be integrally formed with the battery unit, or may be assembled as an additional element. The battery unit 40 is a rechargeable battery such as a nickel-cadmium battery (Ni-Cd), a nickel-hydrogen battery (Ni-MH), a lithium ion battery (Li-ion), a lithium ion polymer battery (Li-Poly), or the like.

Figure 5A:
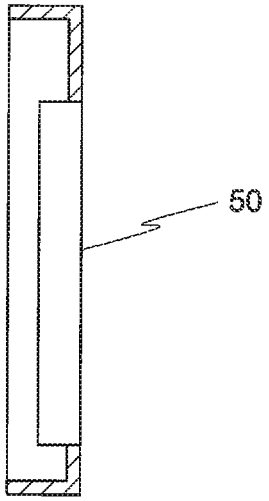
FIG. 5A is a section view of the body according to an embodiment of the present invention.
Figure 5B:
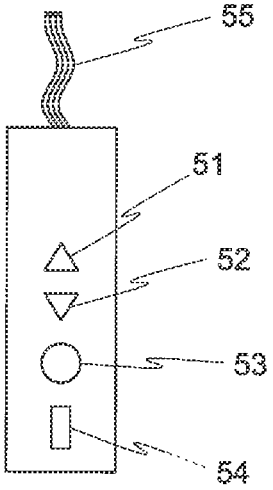
FIG. 5B is a schematic view of a membrane panel of the hearing aid device according to an embodiment of the present invention.
Figure 6:
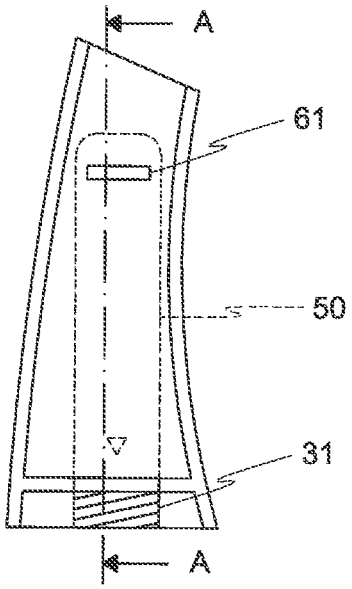
FIG. 6 illustrates a schematic diagram of assembling membrane panel with the body according to an embodiment of the present invention.

Please refer to FIGS. 5-6. FIG. 5A is a section view of the body according to an embodiment of the present invention. FIG. 5B is a schematic view of a membrane panel of the hearing aid device according to an embodiment of the present invention. FIG. 6 illustrates a schematic diagram of assembling membrane panel with the body according to an embodiment of the present invention. Membrane panel 50 comprises volume control buttons 51-52, a power button 53, microphone 54 and wires 55. The user controls the hearing aid device by a membrane panel 50, for example, the user uses the power button 53 to activate or deactivate the hearing aid device, and volume control buttons 51-52 to control the volume of the hearing aid device. In one embodiment, the microphone 54 is a waterproof microphone, for example, the microphone 54 is covered with a layer of waterproof film, for another example, the microphone 54 is placed a fine mesh in front of the microphone 54 prompting the water to follow its natural tendency through cohesion and surface tension to stick to itself rather than passing through such as this way the waterproof function can be reached. Signals received by the microphone 54 are transmitted from membrane panel 50 through the wires 55 to the circuit (not shown) inside the hearing aid device. FIG. 5A is a sectional view along line A-A of FIG. 6. In one embodiment, as shown in FIG. 5A, the outside surface of the body may have a recessed space for accommodating the membrane panel 50, so that the hearing aid device can install the membrane panel 50 with smooth or flat surface in appearance.

The membrane panel 50 is mounted on outer surface of the body. Please refer to FIG. 6, after installation, the wires 55 of the membrane panel 50 are electrically coupled with the circuit unit inside the hearing aid device via the opening 61 of the body and then signals are transmitted between the membrane panel 50 and the circuit of the hearing aid device.

Figure 7A:
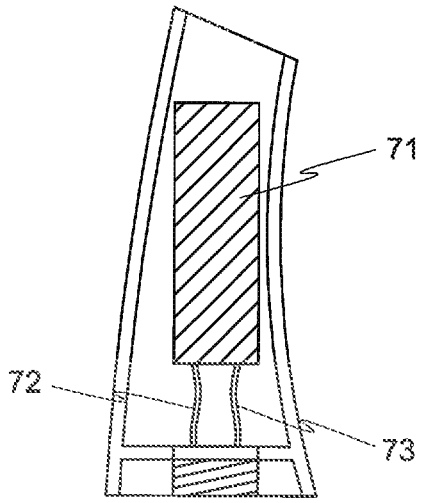
FIGS. 7A-7B illustrate a side view and a sectional view of assembling the body with the hearing aid module according to an embodiment of the present invention.
Figure 7B:
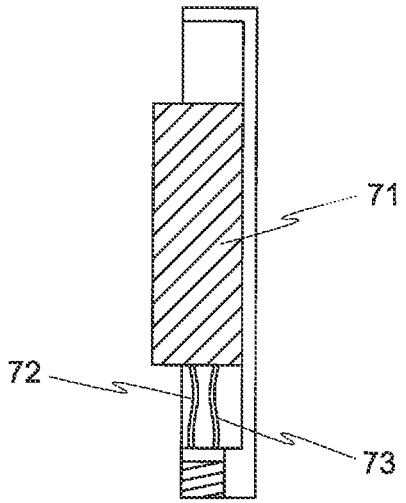

Please refer to FIGS. 5-7. FIGS. 7A-7B illustrate a side view and a sectional view of assembling the body with the hearing aid module according to an embodiment of the present invention. Hearing aid module 71 comprises a circuit unit (not shown), is electrically coupled to the membrane panel through the wires 55 and electrically coupled to the battery unit 40 through wires 72, 73. The battery unit 40 can provide power to the hearing aid module 71 through the wires 72, 73.

Figure 8:
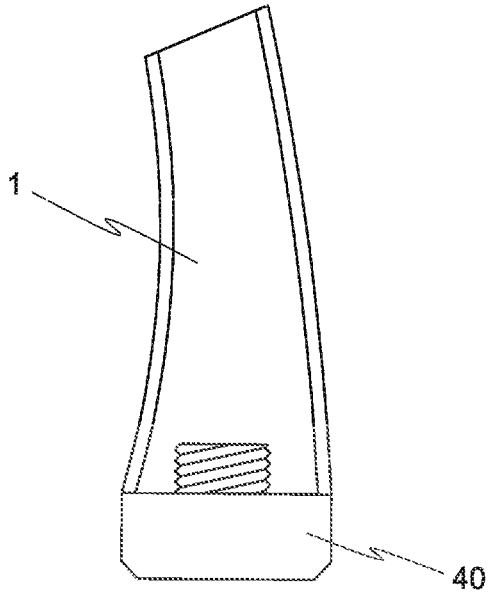
FIG. 8 illustrates a sectional view of assembling the body with the battery unit according to an embodiment of the present invention.
Figure 8A:
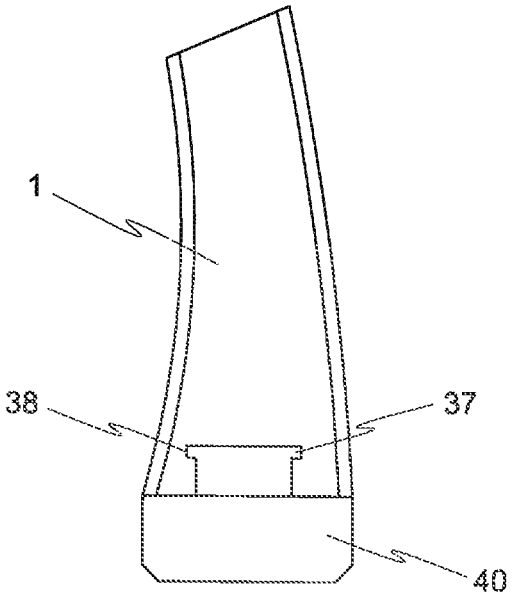
FIG. 8A illustrates a sectional view of assembling the body with the battery unit according to another embodiment of the present invention.

FIG. 8 illustrates a sectional view of assembling the body with the battery unit according to an embodiment of the present invention. As described above, the battery unit 40 has structures, such as thread or a snap (for example, shown as FIG. 8A), capable of assembled with the body 1. After the body land the battery unit 40 are assembled together, it can be sealed to achieve the waterproof effect by convex structure.

Figure 9:
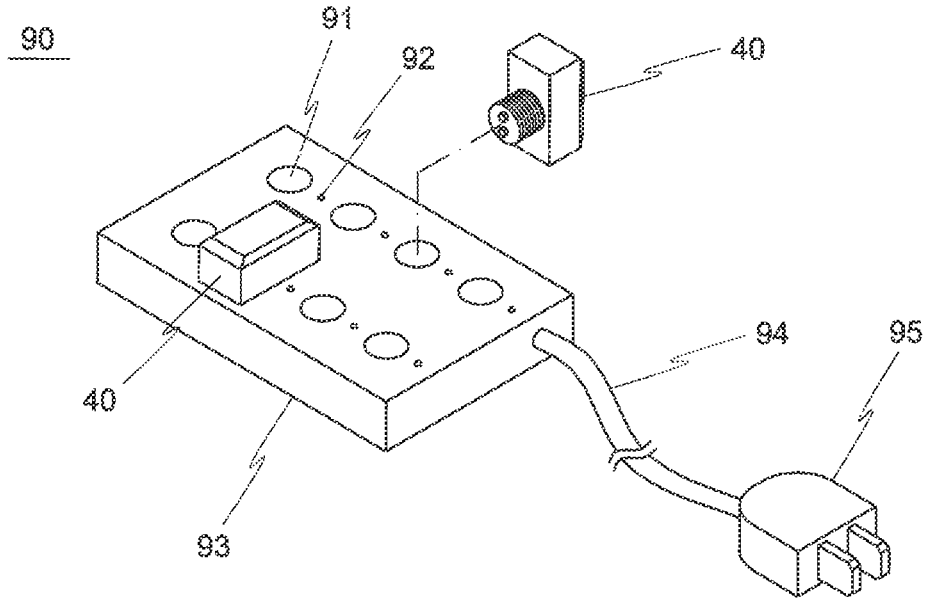
FIG. 9 illustrates a schematic diagram of charging stand according to an embodiment of the present invention.
Figure 9A:
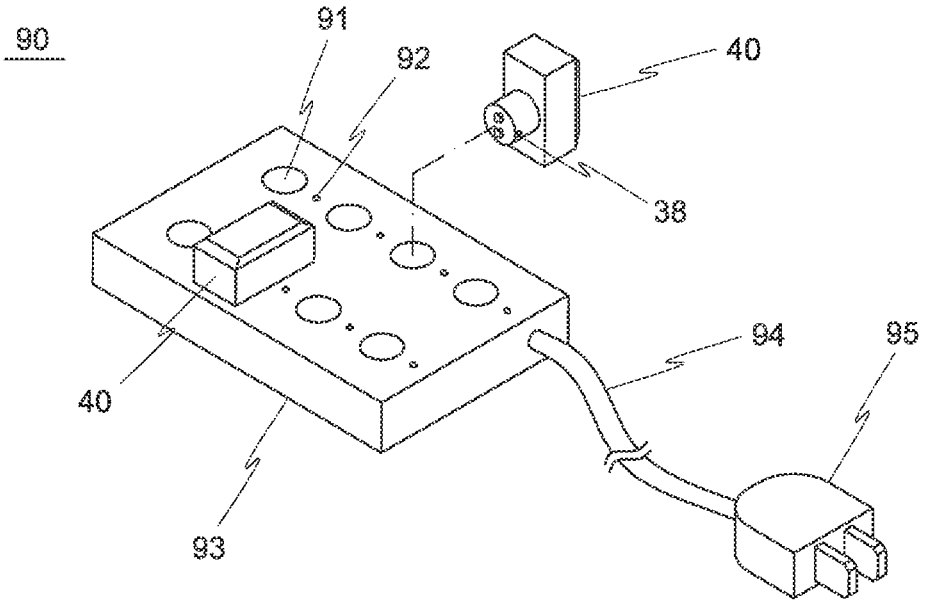
FIG. 9A illustrates a schematic diagram of charging stand according to another embodiment of the present invention.

FIG. 9 illustrates a schematic diagram of charging stand according to an embodiment of the present invention. The charging stand 90 comprises at least one charging hole 91, a charging status indicator 92, a charging stand body 93, a power cord 94, and a power plug 95. The charging stand body 93 of the charging stand 90 has at least one charging hole 91, for example, when the user has two hearing aid devices, the charging stand body 93 preferably has an even number of charging holes 91, for example, 2, 4, 6 or 8, but not limited in even number. The battery unit 40 of the hearing aid device is electrically coupled with the charging stand body 93 by using mounting structure such as a thread or a snap structure (for example, shown as FIG. 9A), but even if there is no mounting structure as mentioned above, as long as the charging hole 91 can accommodate electrodes (not shown) of the battery unit 40, and the battery unit 40 can be placed over the charging hole 91 and electrically coupled to the charging stand body 93 via the electrodes, then the charging function can be achieved. In one embodiment, there is no charging hole on the charging stand body 93, there are only charging electrodes on the charging stand body 93 capable of electrically coupled with the battery unit 40. In one embodiment, the charging stand body 93 also has a charging status indicator 92, for example, each of the charging hole 91 is configured to have at least one charging status indicator 92 to show the charging status of the battery unit 40. When only one charging status indicator 92 is arranged next to each charging hole 91, the current charging status, such as under charging and charging completed, of the battery unit 40 may be indicated in a state of flashing, constant light or constant dark by the charging status indicator 92. It is also possible to configure two charging status indicators 92 next to each charging hole 91, and use different color LED to display the current charging status of the battery unit 40, such as green LED indicates under charging and red LED indicates charging is completed. Generally, if the charging stand body 93 does not sense existence of the battery unit 40, the charging status indicator 92 is in a constant dark status. At this time, the battery unit 40 may not be inserted completely or the battery unit 40 may not be electrically coupled to the charging stand body 93. The charging stand 90 is connected to a AC power or DC power (such as 5V DC) via a power plug 95 of the power cord 94, and the power can be converted into a voltage required by the battery unit 40 by a transformer (not necessarily) for charging. In this way, the battery unit 40 can be used repeatedly without discarding the battery unit when the battery power is exhausted, which result in waste of resource.

Figure 10:
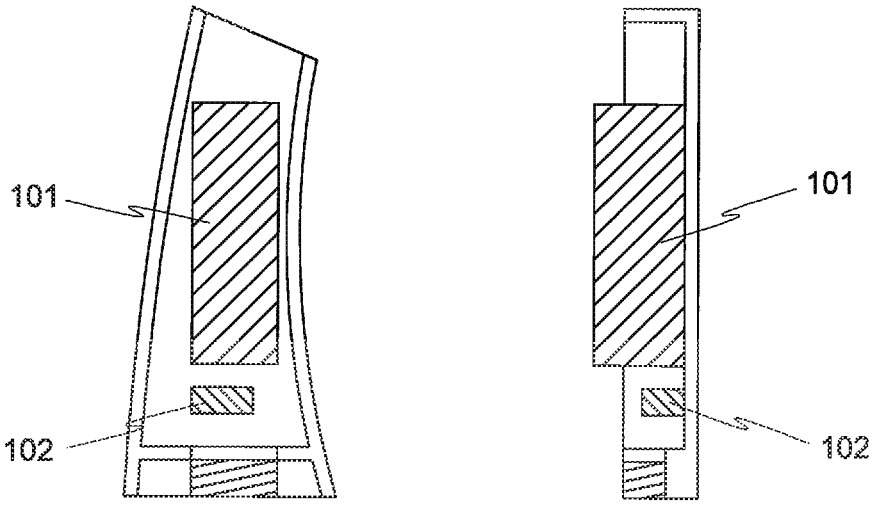
FIG. 10 illustrates a schematic diagram of the hearing aid device installing a wireless communication module according to an embodiment of the present invention.

FIG. 10 illustrates a schematic diagram of the hearing aid device installing a wireless communication module 102 according to an embodiment of the present invention. The wireless communication module 102 is electrically coupled with the circuit unit (not shown) of the hearing aid module 101. In addition, the wireless communication module 102 communicates with external wireless devices and receives/transmits signals to the hearing aid module 101. The wireless communication module 102 comprises a receiver and a transmitter, for example, a control signal received by a membrane panel, can be sent to an external wireless device through the hearing aid module 101 and the transmitter, and the hearing aid module 101 can also receive signals of external wireless devices through the wireless communication module 102. In one embodiment, the wireless communication module 102 is a Bluetooth module, but in another embodiment, it may also be a module that can communicate with external devices under other communication protocols. In another embodiment, the wireless communication module 102 can also be integrated with the hearing aid module 101.

Figure 11:
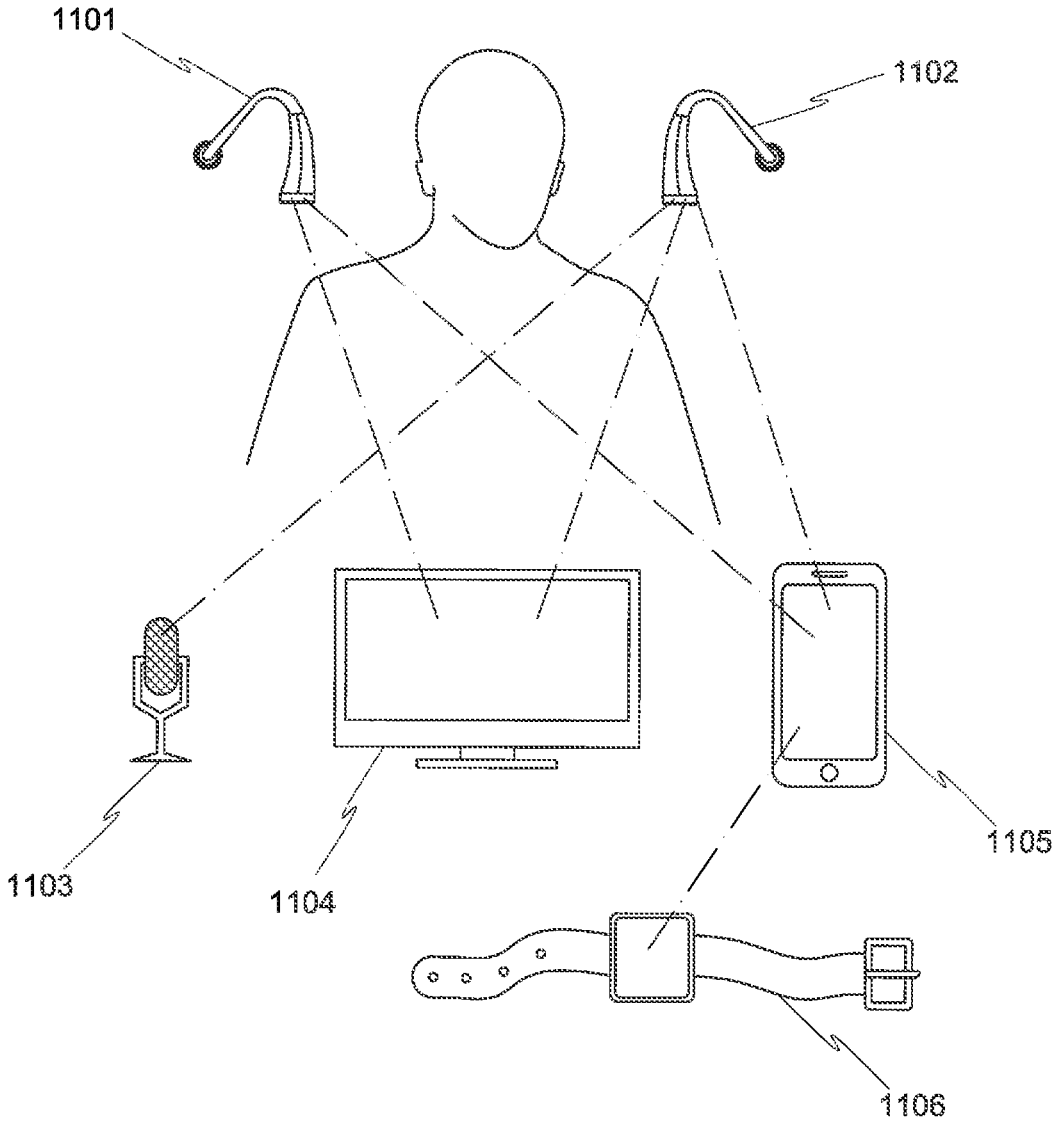
FIG. 11 illustrates a schematic diagram of communication between a hearing aid devices and Bluetooth devices according to an embodiment of the present invention.

FIG. 11 illustrates a schematic diagram of communication between hearing aid devices and Bluetooth devices according to an embodiment of the present invention. The sound source of the hearing aid device may be a Bluetooth device, and the Bluetooth device comprises but is not limited to a microphone 1103, a smart TV 1104, a smart phone 1105, and a smart watch 1106. The microphone 1103, the smart TV 1104, and the smart phone 1105 are able to communicate with the hearing aid devices 1101 and 1102, respectively. In one embodiment, the smart watch 1106 may communicate directly with the hearing aid devices 1101 and 1102, in another embodiment, the smart watch 1106 can communicate with the hearing aid devices 1101 and 1102 via the smart phone 1105. In another embodiment, there may also be only one hearing aid device 1101 or 1102. However, it is not limited to a Bluetooth device in practice, and any wireless device conforming to the spirit of the present invention falls within this category. In addition, one hearing aid device can also achieve the function as mentioned, the number of the hearing devices is not limited.

For example, after the hearing aid devices 1101, 1102 and the smart phone 1105 are paired, if there is an emergency message notification, such as an earthquake or tsunami warning, the alert signal may be received by the smart phone 1105 and transmitted to the hearing aid device 1101 and 1102 instantly. The user may use this method to receive emergency message notifications through the hearing aid devices at the first time without missing notifications when volume of the smart phone 1105 is too small or the user does not notice the messages. But the messages are not limited to emergency notification messages and may be general voice communication, SMS messages.

For another example, if the hearing aid devices 1101 and 1102 communicate with a media device, such as a TV 1104, a smart phone 1105, or a computer (not shown), the hearing aid devices 1101 and 1102 may receive the media sound through the Bluetooth device so as to achieve better listening performance.

Figure 12A:
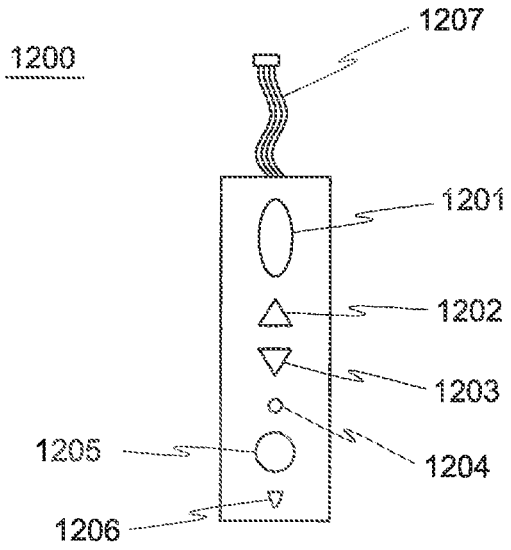
FIG. 12A illustrates a schematic diagram of a membrane panel according to another embodiment of the present invention.
Figure 12B:
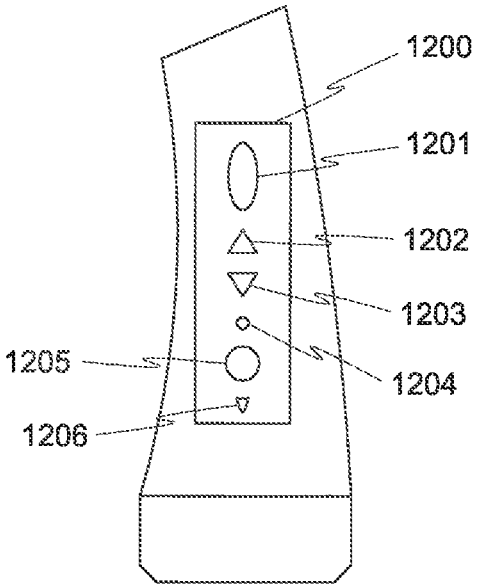
FIG. 12B illustrates a schematic diagram of assembling the hearing aid device with the membrane panel according to another embodiment of the present invention.

Then, please refer to FIGS. 12A, 12B. FIG. 12A illustrates a schematic diagram of a membrane panel according to another embodiment of the present invention. FIG. 12B illustrates a schematic diagram of assembling the hearing aid device with the membrane panel according to another embodiment of the present invention. In one embodiment, the hearing aid device is mounted with a Bluetooth module, the hearing aid device has a membrane panel 1200 comprising: a mode selection button 1201, volume control buttons 1202-1203, indicator 1204, a power button 1205, a microphone 1206, and wire 1207. The user uses power button 1205 turning on or off the hearing aid device, selects sound source, for example, bluetooth devices such as smart phone or smart TV or ambient sound, through the mode selection button 1201, and uses the volume control buttons 1202-1203 to adjust the volume of the sound source. The current sound source, selected by the user, is informed through the indicator 1204. For example, the indicator shows red when the sound source is a Bluetooth device and green when the sound source is ambient sound, the display result of the indicator can be adjusted depending on the actual requirement of the user. If the sound source is an ambient sound, the hearing aid device may receive the ambient sound through the microphone 1206 or other Bluetooth devices. In one embodiment, the membrane panel 1200 can be mounted on outside surface of the hearing device shown as FIG. 12B.

Figure 13:
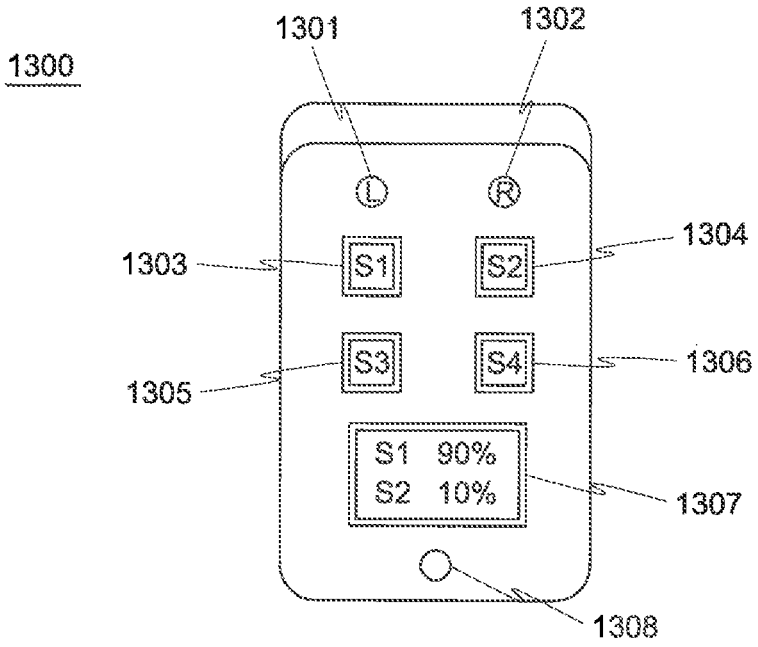
FIG. 13 illustrates a schematic diagram of a user interface of an application according to an embodiment of the present invention.

FIG. 13 illustrates a schematic diagram of a user interface of an application according to an embodiment of the present invention. In one embodiment, the hearing aid device can communicate with the smart phone. In another embodiment, when the user uses the smart phone, the user can perform general phone calls and communication through the hearing aid device via Bluetooth. For example, the microphone on the hearing aid device may be used to receive the voice spoken by the user and the speaker on the hearing aid device may be used to play the voice of the other user during the phone call. Other information of the smart phone may also be further received through the hearing aid device. For example, when the smart phone receives a message, such as text message, the user may be reminded of the message via the hearing aid device by vibration or sound. Therefore, in a preferred embodiment, the user uses the application, having the user interface to control the hearing aid device, via the smart phone. The application stated in the present invention is not limited to be used in a smart phone, but can also be any system that are able to control the hearing aid device, such as smart phone, smart watch, but it is not limited thereto. The system may also have a display or physical buttons as a user interface to control the hearing aid device. The user interface 1300 of the application comprising: hearing aid device selecting buttons 1301-1302, sound source selection buttons 1303-1306, mix button 1307, reset button 1308. In one embodiment, the hearing aid devices are left/right hearing aid devices separately, the user selects left/right hearing aid device to communicate/control, respectively, by hearing aid device selecting buttons 1301-1302, for example, selecting hearing aid device selecting button 1301 to output the sound to the user's left ear, selecting hearing aid device selecting button 1302 to output the sound to the user's right ear, and using the sound source selection buttons 1303-1306 to select the corresponding source of the sound, such as a smart phone, music player, TV, microphone, etc. However, in another embodiment, the user can also select more than one sound source to communicate with left/right hearing aid devices, respectively. For example, the user first selects the hearing aid device selecting button 1301 to select the left hearing aid device and selects the sound source selection button 1303 to pair the left hearing aid device with the TV, then selects the hearing aid device selecting button 1302 to select the right hearing aid device and selects the source selection button 1304 to pair the right hearing aid device with smart phone. Thus, the user can listen to the TV by left ear and communicate with other person by right ear. In one embodiment, the user interface 1300 further comprises mix button 1307, for example, the user can select the ratio of Bluetooth device (paired with the source selection button 1303 labeled S1) and the ambient sound (paired with the source selection button 1304 labeled S2), i.e. determine the ratio of different sound input to the hearing aid device. In another embodiment, selecting the sound source selection button 1303 can further display the ratio of different sound sources input to the hearing aid device. For example, the user works in an environment that requires a high degree of concentration, then 90% Bluetooth device and 10% ambient sound are selected, and users can work with less interference. If the user is exercising outdoors, he needs to pay attention to the surrounding environment, he can choose 70% Bluetooth device, 30% ambient sound. Thus, the user can use Bluetooth device to listen to music, and also pay attention to the cars and the possibilities of accidents can be reduced. The user can also use the reset button to reset the function of hearing aid device to the default state. In addition, the selection methods of pairing and mixing button can be easily completed by a person ordinarily skilled in the art, therefore it will not be described in detail here.

Figure 14:
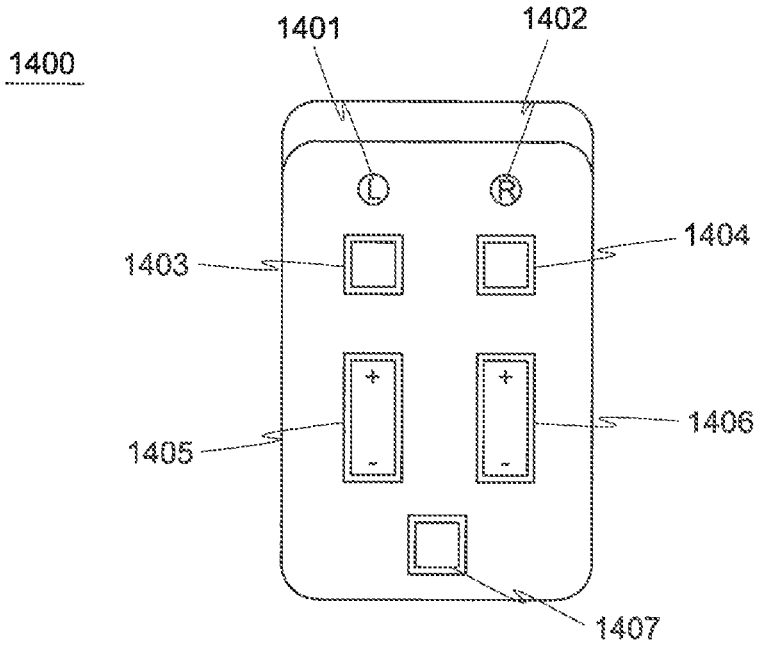
FIG. 14 illustrates a schematic diagram of a user interface of an application according to another embodiment of the present invention.

FIG. 14 illustrates a schematic diagram of a user interface of an application according to another embodiment of the present invention. The user interface 1400 of application comprising: hearing aid device selecting buttons 1401-1402, hearing aid device switches 1403-1404, volume control buttons 1405-1406 and reset button 1407. In one embodiment, the hearing aid devices are left/right hearing aid device separately, the user selects left/right hearing aid device to communicate/control, respectively, by hearing aid device selecting buttons 1401-1402, for example, selecting hearing aid device selecting button 1401 to output the sound to the user's left ear, selecting hearing aid device selecting button 1402 to output the sound to the user's right ear, and adjusting the volume of left/right hearing aid devices respectively through the volume control buttons 1405-1406 to avoid the situation where the user's left and right ears are damaged in different level, if the same volume adjustment is made to both ears, one ear can hear sound normally but the other ear may hear sound unclearly or feel uncomfortable. In one embodiment, the user can turn off one of the hearing devices by the hearing aid device switches 1403-1404. For example, the user selects the hearing aid device switch 1403 to turn off left hearing aid device and can use left ear to hear ambient sound directly. The user can also use the reset button 1407 to reset the function of the hearing aid device to the default state. The number of physical switches and the number of device openings of the hearing aid device can be reduced by utilizing the user interface of the application, thus the manufacturing cost can be reduced, and the waterproofness of the hearing aid device can also be improved.

Figure 15:
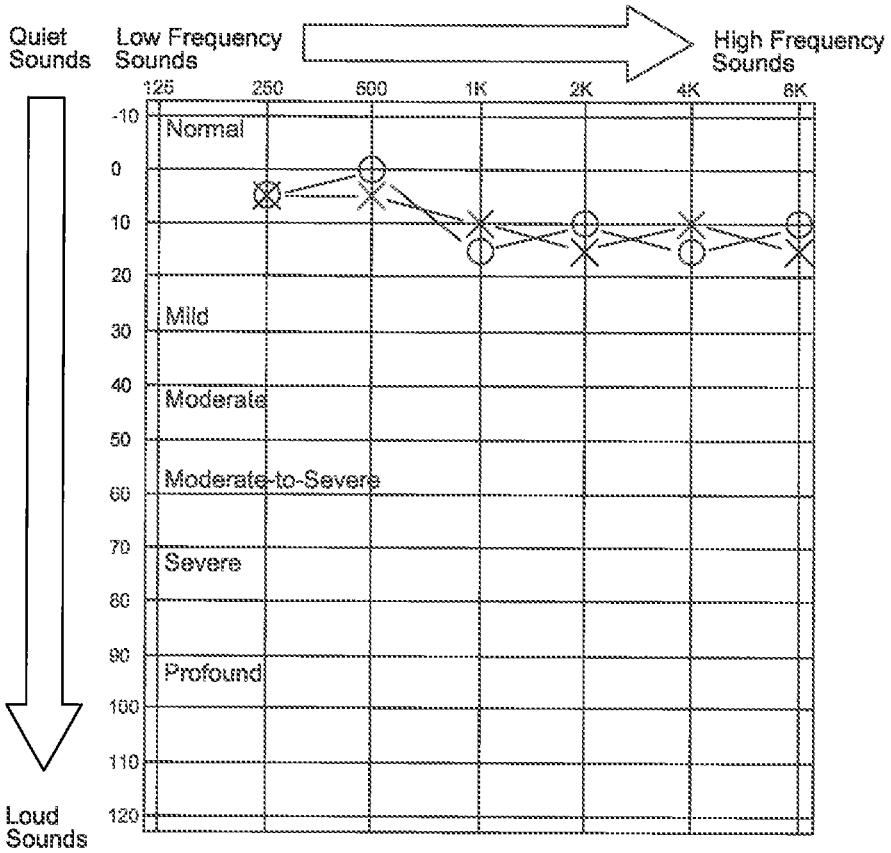
FIG. 15 illustrates a schematic diagram of audiogram according to an embodiment of the present invention.

FIG. 15 illustrates a schematic diagram of audiogram according to an embodiment of the present invention. In general, hearing impaired people must first go through a hearing test in order to characterize their hearing loss, before getting hearing aids personally dedicated. That is, the setting of the hearing aid device is based on the result of the hearing test. The result of the hearing test is usually expressed in an audiogram as illustrated in FIG. 15. Along the horizontal axis is the frequency of sound, and along the vertical axis is hearing loss, in other words, the severity of hearing loss. Conventionally, a hearing loss of lower than 25 dB is considered mild, between 40-55 dB is moderate, between 55-70 dB is moderate-to-severe, between 70-90 dB is severe, and above 90 dB is profound.

The audiogram in FIG. 15 uses symbol "O" and "X" to denote left and right ears separately, hearing aid technician would use the audiogram to adjust and calibrate the hearing aids device, such as increasing the gains in frequencies where the hearing loss is more severe. The goal is to improve the wearer's hearing as close to normal as possible.

Figure 16:
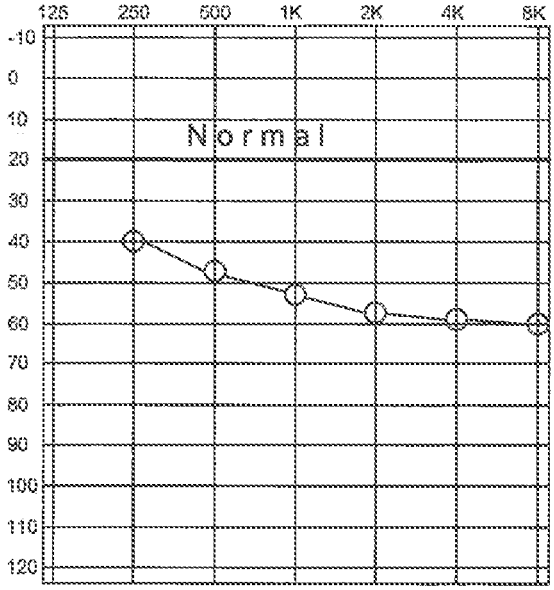
FIG. 16 illustrates a schematic diagram of audiograms of left/right ears according to an embodiment of the present invention.
Figure 16:
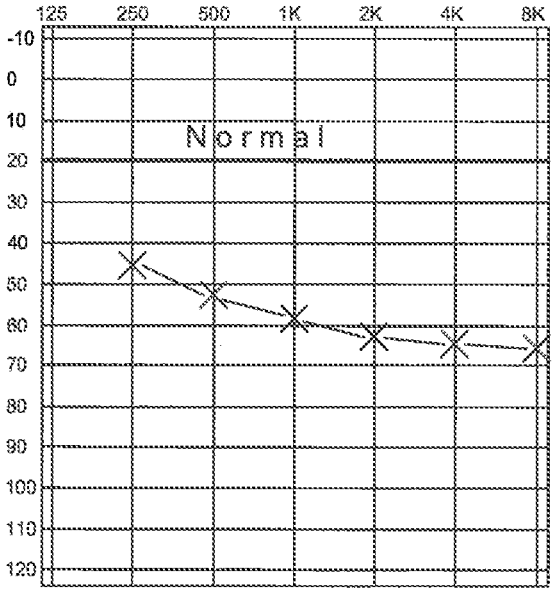

FIG. 16 illustrates a schematic diagram of audiograms of left/right ears according to an embodiment of the present invention. The audiograms of left/right ears are represented in FIG. 16 separately. In one embodiment, it is possible to scan the data of audiogram of the user's left/right ear hearing loss via the camera on the mobile device, and then input the data into the application and transmit the data to the corresponding hearing aid device through the application. In an embodiment, the hearing loss data may also be manually input into the audiogram by the user. That is, the user can enter the amount of hearing loss manually for each frequency through the user interface of the application.

Figure 17A:
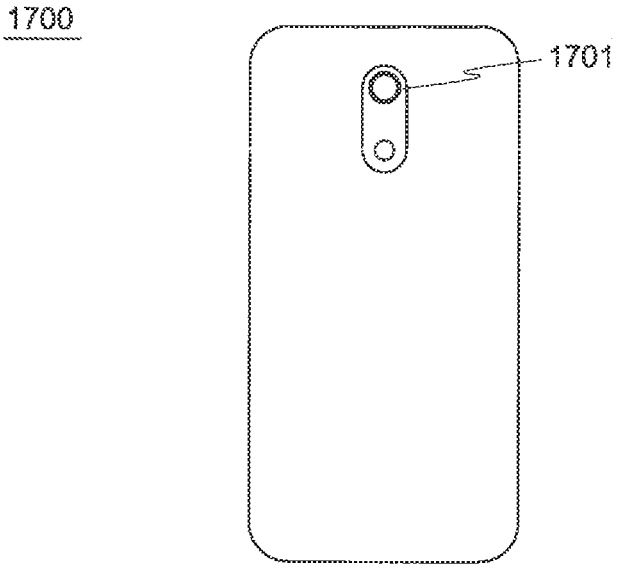
FIG. 17A illustrates a back view of a mobile device according to an embodiment of the present invention.
Figure 17B:
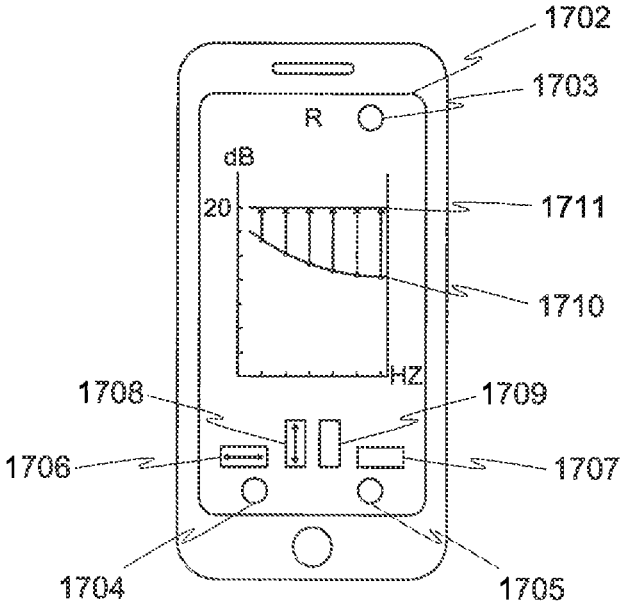
FIG.17B shows a schematic diagram of a user interface of an application according to an embodiment of the present invention.

FIG. 17A illustrates a back view of a mobile device according to an embodiment of the present invention. FIG. 17B shows a schematic diagram of a user interface of an application according to an embodiment of the present invention. In one embodiment, audiogram as shown in FIG. 16 can be generated by using Quick Response code or other RFID systems. Specifically, the camera 1701 on the mobile device 1700 can be used to read the data to perform the same function. If the audiogram is accessible via a QR code, the camera 1701 can also be a QR code reader. Therefore, the user can adjust and calibrate the hearing aid device remotely by using the application on the mobile device.

More specifically, please refer to FIG. 17B. In FIG. 17B, the user interface 1702 comprises a setting button 1703, a hearing aid device selection buttons 1704-1705, frequency selection buttons 1706-1707, volume control buttons 1708-1709, a hearing loss curve 1710, and a normal hearing curve 1711. In one embodiment, after the user uses the camera on the mobile device to read/scan the audiogram, a hearing loss curve 1710 is generated. In another embodiment, the user manually inputs the hearing loss curve 1710. For example, the user first uses the hearing aid device selection buttons 1704-1705 to select the hearing aid device, then selects the frequency to be input through the frequency selection buttons 1706-1707, after selecting the frequency, adjusts volume or gains by using the volume control buttons 1708-1709. The normal hearing curve 1711 is the system default curve, it can also be adjusted depending on the requirement of the user. Finally, the user uses the setting button 1703 to transmit data, comprising the hearing loss curve 1710 and the normal hearing curve 1711, to the hearing aid devices and adjusts and calibrates the hearing aid devices. In other embodiments, the user interface 1702 may also include a reset button (not shown), and the user resets the hearing curve to a default state by using the reset button. In another embodiment, the user interface 1702 can further display the currently controlled hearing aid device. For example, when the right hearing aid device is selected, R is displayed, and when the left hearing device is selected, L is displayed.

Often times, due to the limitations of conventional hearing aid devices and depending on the surrounding situation, sound at a certain frequency will be amplified to an uncomfortable level for the wearer. For example, at a construction site, the amplification of all frequency of sound could result in unbearable noise for the user. Generally speaking, hearing range of human is commonly given as 20 Hz to 20,000 Hz. Within this range, the most sensitive range of human hearing is between 1000 and 4000 Hz. In conventional hearing aid device, the manufacturer or technician would set a fixed filter to lower the volume in this range. However, there is variation between individuals and a fixed volume filter is not suitable in all situations, for instance, being in a concert and being in a car on the highway are very different sound situation.

Figure 18:
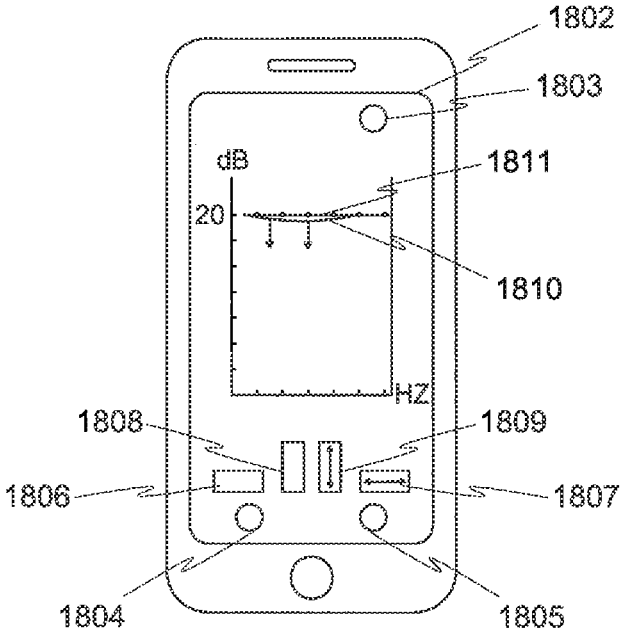
FIG. 18 illustrates a schematic diagram of a user interface diagram of an application according to an embodiment of the present invention.

Therefore, in another embodiment of the present invention, the application has a variable filtering function. FIG. 18 illustrates a schematic diagram of a user interface diagram of an application according to an embodiment of the present invention. The user interface 1802 having a variable filtering function comprises a setting button 1803, a hearing aid device selection buttons 1804-1805, frequency selection buttons 1806-1807, volume control buttons 1808-1809, a hearing loss curve 1810, and a normal hearing curve 1811.

In one embodiment, the user first uses the hearing aid device selection buttons 1804-1805 to select the hearing aid device, then determines the frequency to be input through the frequency selection buttons 1806-1807, after determining the frequency, the normal hearing curve 1811 preset by the system is adjusted to the sound filtering curve 1810 through the volume adjusting button 1808-1809. Finally, the user uses the setting button 1803 to transmit the sound filtering curve 1810 and the normal hearing curve 1811 to the hearing aid device to adjust and calibrate the hearing aid devices. In other embodiments, the user interface 1802 may also include a reset button (not shown), and the user resets the hearing filtering curve to a default state by using the reset button.

Figure 19:
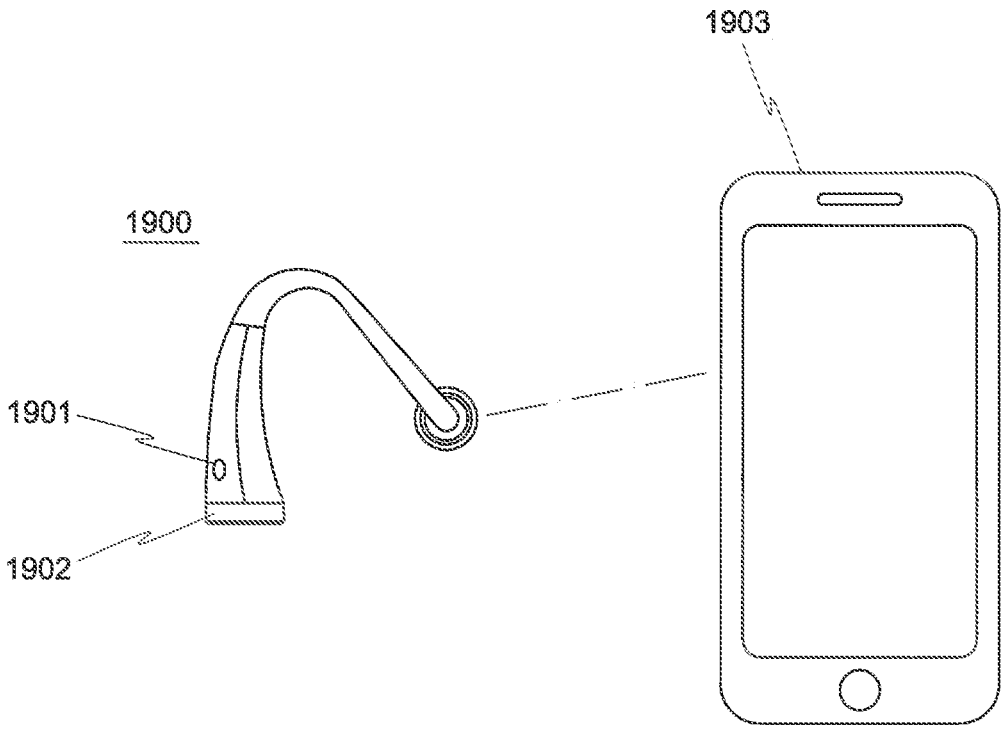
FIG. 19 illustrates a schematic diagram of a hearing aid device pairing with mobile device according to an embodiment of the present invention.

Please refer to FIG. 19. FIG. 19 illustrates a schematic diagram of a hearing aid device pairing with mobile device according to an embodiment of the present invention. In one embodiment, the difference from the previous embodiment is that the hearing aid device 1900 omits the membrane panel and retains only the microphone 1901 to further increase the waterproof performance. In one embodiment, the microphone 1901 is a waterproof microphone, for example, the microphone 1901 is covered with a layer of waterproof film, for another example, the microphone 1901 is placed a fine mesh in front of the microphone 1901 prompting the water to follow its natural tendency through cohesion and surface tension to stick to itself rather than passing through such as this way the waterproof function can be reached. The battery unit 1902 may be the same battery unit as in the previous embodiment, so it will not be described in detail here. In the present embodiment, the number of assembled parts is reduced, and thus the waterproofness of the hearing aid device 1900 can be further enhanced. As for the hearing aid device 1900, an application having a user interface may be used to control the hearing aid device 1900 through the smart phone 1903 or perform two-way communication with the hearing aid device 1900.

It should be noted that the physical buttons or buttons on software interfaces and the screen in the embodiment of the present invention, may also be considered as an independent control unit, but it is not limited thereto.

The above are merely alternative embodiments of the present invention and are not intended to limit the invention. For those persons skilled in the art, the invention may have various changes and modifications. Any modification, equivalent replacement, or improvement made within the spirit and principle of the present invention shall fall within the protection scope of the present invention.

What is claimed is:

1. A hearing aid device comprising:

a body, accommodating a circuit unit;

a ear mold, capable of being accommodated in ear canal to convey sound;

a connecting portion, capable of connecting the body with the ear mold;

a wireless transmission unit, electrically coupled with the circuit unit, capable of communicating with at least one wireless device; and a rechargeable battery unit, coupled with the body and provided with a convex structure on a side facing the body;

wherein the rechargeable battery unit and the body have corresponding snap structures to be coupled with each other; and wherein the body comprises an upper case and a lower case and a sealing structure, the sealing structure being positioned between the upper case and the lower case when the upper case is assembled with the lower case, so that the upper case and the lower case are coupled with each other closely.

2. The hearing aid device according to claim 1, further comprising a microphone.

3. The hearing aid device according to claim 1, further comprising a membrane panel, coupled to outer surface of the body, for a user controlling the hearing aid device.

4. The hearing aid device according to claim 3, wherein the membrane panel comprising at least one of a microphone, a volume control button and a power button.

5. The hearing aid device according to claim 3, wherein the membrane panel comprising a mode selection button for the user to select a sound source.

6. The hearing aid device according to claim 5, wherein the sound source comprising the at least one of wireless device and ambient sound.

7. The hearing aid device according to claim 5, wherein the membrane panel comprising a mode indicator for the user to confirm the currently selected sound source.

8. The hearing aid device according to claim 1, wherein the wireless transmission unit communicate with at least one wireless device via Bluetooth.

9. The hearing aid device according to claim 1, wherein the rechargeable battery unit and the body have threads that match each other.

10. The hearing aid device according to claim 1, wherein the convex structure is a washer or rubber.

11. A system for controlling the hearing aid device according to claim 1, wherein the system comprising a user interface comprising:

a sound source selection unit for the user to select at least one sound source input to the hearing aid device; and a mixing unit, for the user determining input ratio of the different sound sources when the user selects more than one sound source.

12. A system according to claim 11, wherein the system further comprising a reset unit for the user to reset the hearing aid device to a default state.

13. A system for controlling hearing aid devices, comprising:

a left and a right hearing aid device, to respectively output sound to the user's left ear and right ear, the left and right hearing aid each comprising a body, accommodating a circuit unit; an ear mold, capable of being accommodated in an ear canal to convey sound; a connecting portion, capable of connecting the body with the ear mold; a wireless transmission unit, electrically coupled with the circuit unit, capable of communicating with at least one wireless device; a rechargeable battery unit, coupled with the body and provided with a convex structure on a side facing the body; and a reset unit for the user to reset the hearing aid device to a default state; and a left/right hearing aid device selecting unit, for the user selecting the left/right hearing aid device to perform function adjustment; and at least one volume control button, the user adjusts the volume of the left/right hearing aid device via the at least one volume control button respectively, after using the left/right hearing aid device selecting unit to select the left/right hearing aid device.

14. A system for controlling hearing aid devices, comprising:

a left and a right hearing aid device, to respectively output sound to the user's left ear and right ear, the left and right hearing aid each comprising a body, accommodating a circuit unit; an ear mold, capable of being accommodated in an ear canal to convey sound; a connecting portion, capable of connecting the body with the ear mold; a wireless transmission unit, electrically coupled with the circuit unit, capable of communicating with at least one wireless device; a rechargeable battery unit, coupled with the body and provided with a convex structure on a side facing the body; and a user interface, comprising a left/right hearing aid device selecting unit, for the user selecting left/right hearing aid device to perform function adjustment;

a frequency selecting unit, for the user selecting frequency via the frequency selecting unit after using the left/right hearing aid device selecting unit selecting the left/right hearing aid device; and a volume adjustment unit, for the user selecting the volume of the frequency after the user using the frequency selecting unit selecting the frequency.

* * * * *